US011480014B2

(12) United States Patent
Gunda et al.

(10) Patent No.: US 11,480,014 B2
(45) Date of Patent: Oct. 25, 2022

(54) AUTOMATIC FORCE ADJUSTMENT CONTROL SYSTEM FOR MOBILE DRILLING MACHINES

(71) Applicant: Caterpillar Global Mining Equipment LLC, Denison, TX (US)

(72) Inventors: Rajesh R. Gunda, Dunlap, IL (US); Carl J. Moberg, Dunlap, IL (US); Ross L. Hoult, Queensland (AU)

(73) Assignee: Caterpillar Global Mining Equipment LLC, Denison, TX (US)

( * ) Notice: Subject to any disclaimer, the term of this patent is extended or adjusted under 35 U.S.C. 154(b) by 9 days.

(21) Appl. No.: 16/713,749

(22) Filed: Dec. 13, 2019

(65) Prior Publication Data

US 2021/0180405 A1 Jun. 17, 2021

(51) Int. Cl.

| | |
|---|---|
| ***E21B 44/02*** | (2006.01) |
| ***E21B 7/02*** | (2006.01) |
| ***E21B 47/06*** | (2012.01) |

(52) U.S. Cl.

CPC ..... *E21B 7/022* (2013.01); *E21B 47/06* (2013.01)

(58) Field of Classification Search

CPC ..... E21B 44/00; E21B 44/02; E21B 44/06; E21B 4/14

See application file for complete search history.

(56) References Cited

U.S. PATENT DOCUMENTS

| | | | | |
|---|---|---|---|---|
| 3,613,805 | A * | 10/1971 | Lindstad | E21B 21/08 340/853.6 |
| 5,358,058 | A * | 10/1994 | Edlund | E21B 7/025 175/24 |
| 5,449,047 | A * | 9/1995 | Schivley, Jr. | E21B 44/00 173/11 |
| 5,660,241 | A | 8/1997 | Leising et al. | |
| 6,233,498 | B1 | 5/2001 | King et al. | |
| 6,662,110 | B1 | 12/2003 | Bargach et al. | |
| 7,350,593 | B1 * | 4/2008 | Brookover | E21B 7/022 173/11 |
| 8,121,788 | B2 | 2/2012 | Bordakov et al. | |
| 8,146,680 | B2 * | 4/2012 | Mock | E21B 44/04 175/27 |
| 8,261,856 | B1 * | 9/2012 | Stacy, II | E21B 7/00 175/57 |
| 9,279,318 | B2 | 3/2016 | Hay et al. | |
| 9,512,708 | B2 | 12/2016 | Hay | |
| 10,837,233 | B2 * | 11/2020 | Ruetten | E21B 7/022 |
| 2007/0246262 | A1 * | 10/2007 | Brookover | E21B 21/08 175/122 |

(Continued)

FOREIGN PATENT DOCUMENTS

CN 107829678 B 3/2019

*Primary Examiner* — Kipp C Wallace

(74) *Attorney, Agent, or Firm* — Bookoff McAndrews, PLLC

(57) ABSTRACT

Disclosed is an automatic force adjustment control system for mobile drilling machines and methods for automatically adjusting a force on a down-the-hole drill bit of a drill string of a mobile drilling machine. A method may include: monitoring bit air pressure of the down-the-hole drill bit during an automatic down-the-hole drilling operation; and automatically adjusting a force provided to the drill string based on the monitored bit air pressure so that the bit air pressure approaches a target air pressure value.

20 Claims, 4 Drawing Sheets

(56) References Cited

U.S. PATENT DOCUMENTS

| | | | | |
|---|---|---|---|---|
| 2009/0132458 | A1* | 5/2009 | Edwards | E21B 44/00 706/50 |
| 2011/0108323 | A1* | 5/2011 | Stacy, II | E21B 44/00 175/24 |
| 2017/0089136 | A1* | 3/2017 | Fuchs | E21B 1/02 |
| 2018/0108095 | A1* | 4/2018 | Venkatasubbarao | E21B 49/008 |
| 2018/0156022 | A1* | 6/2018 | Miller | E21D 9/006 |

* cited by examiner

AUTOMATIC FORCE ADJUSTMENT CONTROL SYSTEM FOR MOBILE DRILLING MACHINES

TECHNICAL FIELD

The present disclosure relates generally to mobile drilling machines, and more particularly, to an automatic force adjustment control system for such machines.

BACKGROUND

Mobile drilling machines, such as blasthole drilling machines, are typically used for drilling blastholes for mining, quarrying, dam construction, and road construction, among other uses. The process of excavating rock, or other material, by blasthole drilling includes using the blasthole drill machine to drill a plurality of holes into the rock and filling the holes with explosives. The explosives are detonated causing the rock to collapse and rubble of the collapse is then removed and the new surface that is formed is reinforced. Many current blasthole drilling machines utilize rotary drill rigs, mounted on a mast, that can drill blastholes anywhere from 6 inches to 22 inches in diameter and depths up to 180 feet or more.

Blasthole drilling machines may also include a hammer-type drill bit mounted on a drill string for down-the-hole drilling. During the down-the-hole drilling operation, it is desirable to maintain a load force on the drill bit within a predetermined target range while the drill bit moves down the hole for an effective hammering operation of the drill bit on the bottom surface of the hole. The target range for the load force may be determined by bit type and bit size (e.g., diameter of the drill bit). However, the target range for the load force on the drill bit may vary based on the type of ground materials (e.g., hard rock versus softer rock/dirt). For example, the hammering operation may be ineffective if the load force is not enough to maintain adequate force between the drill bit and the bottom of the hole (e.g., when the ground material is softer). Further, the drill bit or drill string may be damaged if too much load force is exerted on the drill bit, and/or the forces may inhibit the hammering motion of the drill bit (e.g., when the ground material is harder). Thus, the drill bit may wear at increased rates and the life of the drill bit may be reduced.

U.S. Pat. No. 9,279,318, issued to Hay et al. on Mar. 8, 2016 (the '318 patent), describes systems and methods for automatic weight on bit sensor calibration and regulating buckling of a drill string. The method includes taking a first survey recording at a first depth within a borehole for providing a curvature of a drill string at the first depth, and measuring a weight on a drill bit at the first depth with a senor sub arranged on a bottom hole assembly. The method calculates a predicted borehole curvature at a second depth within the borehole. The method of the '318 patent then calculates a weight correction value based on the predicted hole curvature and calibrates the sensor sub with the weight correction value. However, the method of the '318 patent may not adequately adjust the weight on the drill bit. Further, the '318 patent does not disclose automatically adjusting a force on a down-the-hole drill bit.

The automatic force adjustment control system of the present disclosure may address or solve one or more of the problems set forth above and/or other problems in the art.

The scope of the current disclosure, however, is defined by the attached claims, and not by the ability to solve any specific problem.

SUMMARY

In one aspect, a method for automatically adjusting a force on a down-the-hole drill bit of a drill string of a mobile drilling machine is disclosed. The method may include: monitoring bit air pressure of the down-the-hole drill bit during an automatic down-the-hole drilling operation; and automatically adjusting a force provided to the drill string based on the monitored bit air pressure so that the bit air pressure approaches a target air pressure value.

In another aspect, a method for automatically adjusting a force on a down-the-hole drill bit of a drill string of a mobile drilling machine is disclosed. The method may include: monitoring bit air pressure of the down-the-hole drill bit during an automatic down-the-hole drilling operation; and when the monitored bit air pressure is stabilized, automatically adjusting a force provided to the drill string based on the monitored bit air pressure so that the bit air pressure approaches a target air pressure value.

In yet another aspect, a mobile drilling machine is disclosed. The mobile drilling machine may include: a mast including a mast frame; a drill head movably mounted on the mast frame, the drill head controllable to rotate a down-the-hole drill bit mounted on a drill string; an air supply configured to supply air at a bit air pressure to the down-the-hole drill bit to provide a hammering action at the drill bit; a drill drive assembly configured to apply a force to move the drill head up and down along a length of the mast frame; and a controller configured to: monitor bit air pressure of the down-the-hole-drill bit during an automatic down-the-hole drilling operation; and automatically adjust a force provided to the drill string based on the monitored bit air pressure so that the bit air pressure approaches a target air pressure value.

BRIEF DESCRIPTION OF THE DRAWINGS

The accompanying drawings, which are incorporated in and constitute a part of this specification, illustrate various exemplary embodiments and together with the description, serve to explain the principles of the disclosure.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Further, relative terms, such as, for example, "about," "substantially," "generally," and "approximately" are used to indicate a possible variation of ±10% in a stated value.

Figure 1:
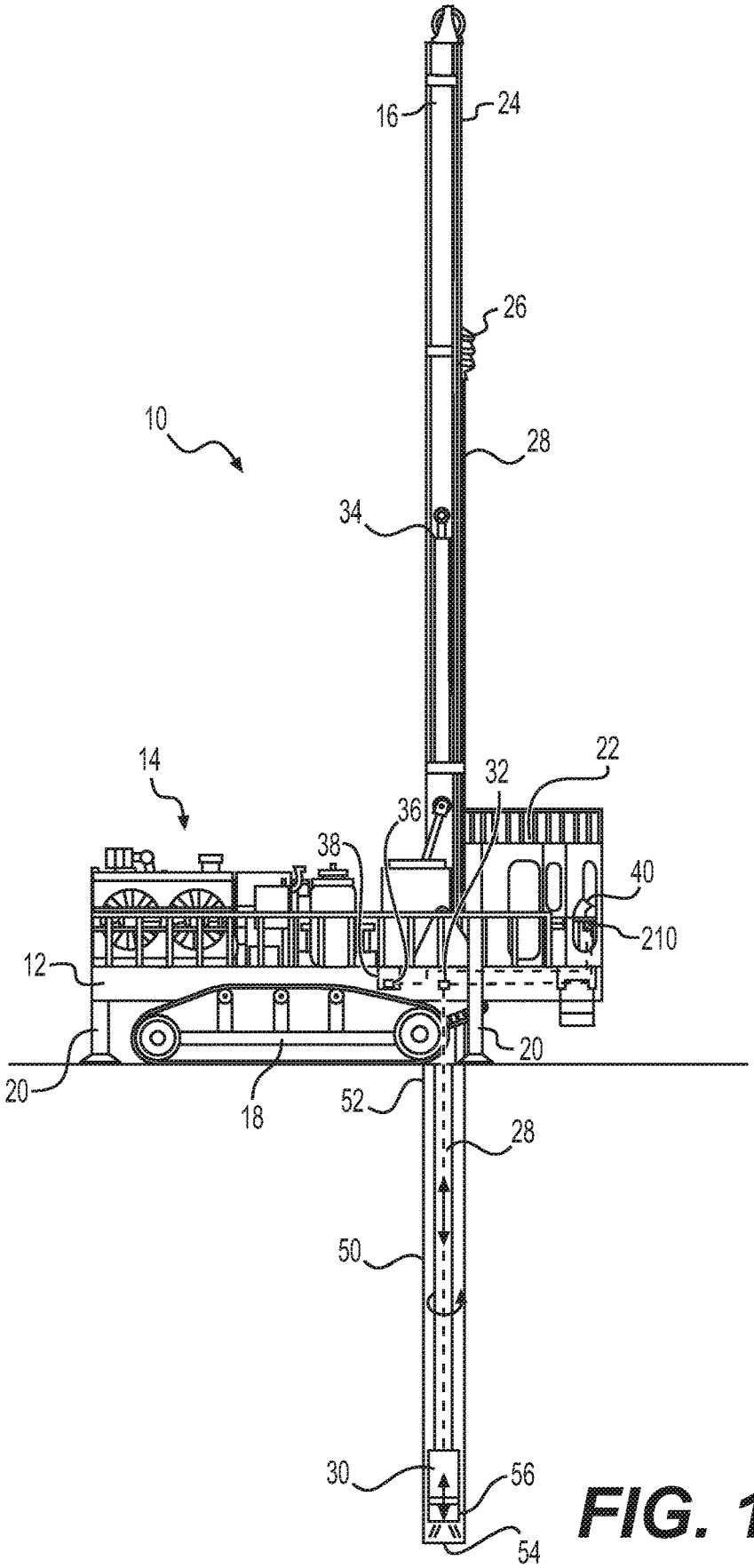
FIG. 1 illustrates a schematic side view of a drilling machine with an exemplary automatic force adjustment control system, according to aspects of the disclosure.

FIG. 1 illustrates a schematic side view of an exemplary drilling machine 10. The disclosure herein may be applicable to any type of drilling machine, however, reference will be made below particularly to a mobile blasthole drilling machine. As shown in FIG. 1, mobile drilling machine 10 may include a frame 12, machinery 14, and a drilling mast 16. Frame 12 may be supported on a ground surface by a transport mechanism, such as crawler tracks 18. Crawler tracks 18 may allow mobile drilling machine 10 to maneuver about the ground surface to a desired location for a drilling operation. Frame 12 may further include one or more jacks 20 for supporting and leveling mobile drilling machine 10 on the ground surface during the drilling operation. Frame 12 may support the machinery 14, which may include engines, motors, batteries, pumps, air compressors, a hydraulic fluid storage tank 38 (shown schematically in FIG. 1) and/or any other equipment necessary to power and operate mobile drilling machine 10. Frame 12 may further support an operator cab 22, from which a user, or operator, may maneuver and control mobile drilling machine 10 via user interfaces and displays 40.

As further shown in FIG. 1, drilling mast 16 may include a mast frame 24 which may support a drill motor assembly, or rotary head 26, movably mounted on the mast frame 24. Rotary head 26 may couple to, and may be controllable to rotate, a drill string 28 of drilling pipe segments on which a down-the-hole hammer-type drill bit 30 may be mounted for down-the-hole drilling into the ground surface, as further described below. Rotary head 26 may be any type of rotary head, such as a hydraulic rotary head or the like.

Drilling mast 16 may further include a hydraulic feed cylinder 34 (located within mast frame 24) connected to rotary head 26 via a cable and pulley system (not shown) for moving rotary head 26 up and down along the mast frame 24. As such, when hydraulic feed cylinder 34 is extended, hydraulic feed cylinder 34 may exert a force (e.g., a pull-down force) on rotary head 26 for pulling-down rotary head 26 along mast frame 24. Likewise, when hydraulic feed cylinder 34 is retracted, hydraulic feed cylinder 34 may exert a force on rotary head 26 for hoisting up rotary head 26 along mast frame 24. Thus, hydraulic feed cylinder 34 may be controllable to control rotary head 26 to move up and down the mast frame 24 such that drill bit 30 on drill string 28 may be pulled-down towards, and into, the ground surface or hoisted up from the ground surface. As used herein, the term "feed" in the context of the feed cylinder 34 includes movement of the drill string 28 in either direction (up or down). Hydraulic feed cylinder 34 may include hydraulic fluid lines (not shown) for receiving and conveying hydraulic fluid to and from the feed cylinder 34. The hydraulic fluid may be used to actuate hydraulic cylinder 34 such that a rod of hydraulic cylinder 34 may be extended or retracted. The hydraulic fluid line of hydraulic cylinder 34 may be coupled to hydraulic valves 36 (shown schematically in FIG. 1) for controlling the amount, and flow rate and pressure, of the hydraulic fluid into hydraulic cylinder 34. In the exemplary embodiment, hydraulic valve 36 may be located on the hydraulic fluid storage tank 38. However, hydraulic valve 36 may be located anywhere along the hydraulic fluid line of the hydraulic cylinder 34, as necessary. It is understood that hydraulic fluid may be any type of hydraulic fluid, such as hydraulic oil or the like. Further, it is understood that other systems for moving drill string 28 (and thus drill bit 30) may be used.

FIG. 1 shows the drill string 28 located in hole 50. The hole 50 includes a collaring portion 52 at a top portion of the hole, and a bottom of the hole 54 (e.g., desired depth of hole). As shown by the arrows in FIG. 1, drill string 28 can rotate, and move up and down (e.g. feed) such that drill bit 30 rotates and moves up and down, respectively. Further, drilling machine 10 may include an air supply 32 for supplying air through an air supply line (shown by dashed line) to drill bit 30 at a bit air pressure. The air supply 32 may include an air tank, a compressor, and the air supply line. Accordingly, the hammer-type drill bit 30 may utilize a percussion mechanism 56, such as a piston, controlled by the air pressure to repeatedly strike the drill bit 30 for "hammering" into the bottom surface 54 of hole 50 as the drill bit 30 is fed into the hole 50.

Figure 2:
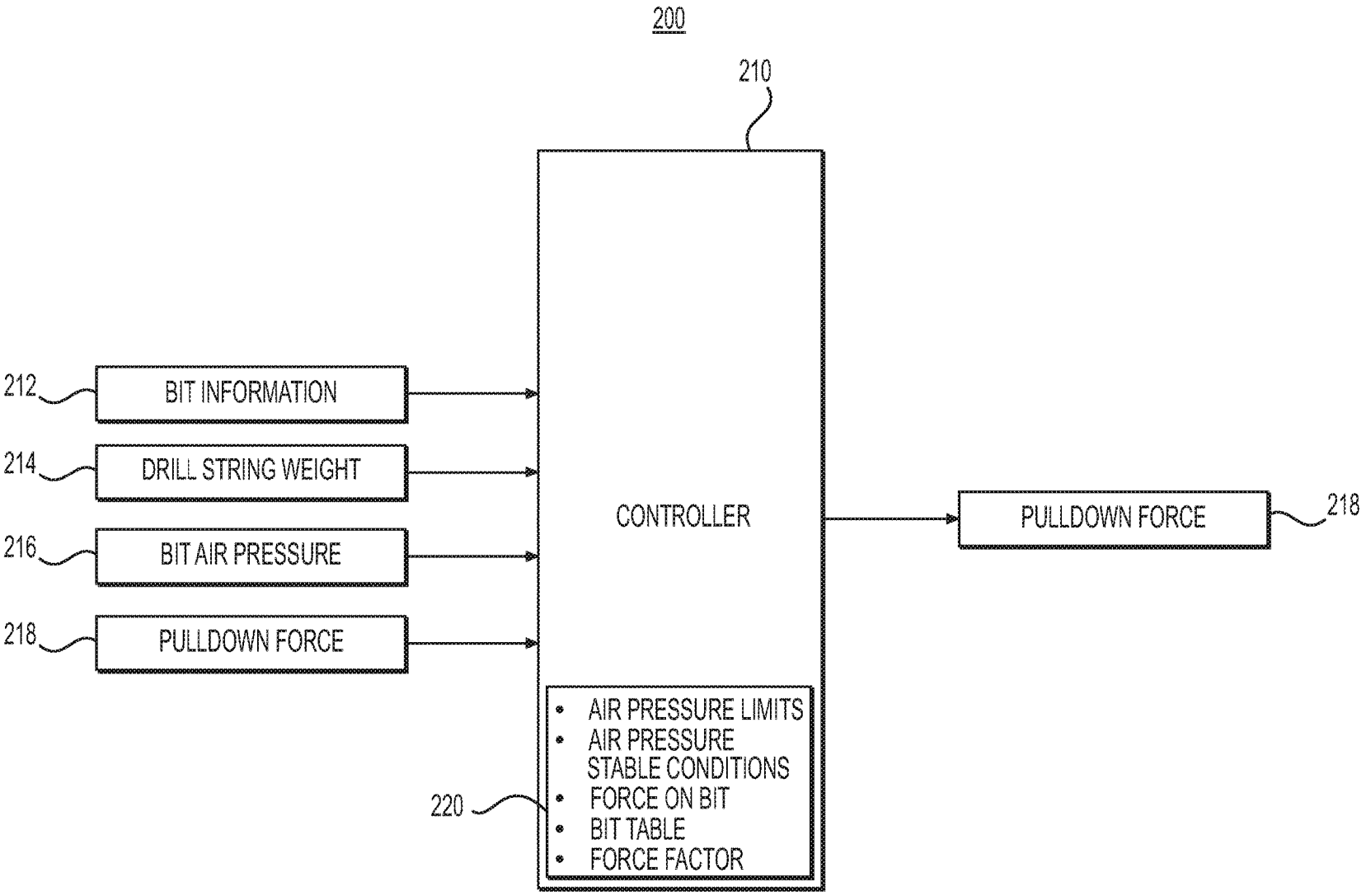
FIG. 2 illustrates a schematic view of the exemplary automatic force adjustment control system of the drilling machine of FIG. 1.

FIG. 2 illustrates a schematic view of the exemplary down-the-hole drilling control system of the drilling machine 10 of FIG. 1. Control system 200 may include inputs 212-220, controller 210, and output 218. The inputs may include sensor input, operator inputs, and/or stored inputs, for example, bit information 212, drill string weight 214, bit air pressure 216, pulldown force, and stored and/or derived values 220. The stored and/or derived values may include air pressure limits, air pressure stable conditions, force on bit, one or more bit tables, and a force factor. Such sensors, operator input, or stored inputs may be obtained using any conventional system (sensors, operator interfaces, etc.). The output may include, for example, adjusting the pulldown force 218 applied to the drill string 28, as detailed below.

Controller 210 may be located on drilling machine 10 and embody a single microprocessor or multiple microprocessors that may include means for monitoring operation of the drilling machine 10 and issuing instructions to components of machine 10. For example, controller 210 may include a memory, a secondary storage device, a processor, such as a central processing unit or any other means for accomplishing a task consistent with the present disclosure (e.g., the methods of FIGS. 3 and 4). The memory or secondary storage device associated with controller 210 may store data and/or software routines that may assist controller 210 in performing its functions. Further, the memory or secondary storage device associated with controller 210 may also store data received from the various inputs associated with mobile drilling machine 10. Numerous commercially available microprocessors can be configured to perform the functions of controller 210. It should be appreciated that controller 210 could readily embody a general machine controller capable of controlling numerous other machine functions. Various other known circuits may be associated with controller 210, including signal-conditioning circuitry, communication circuitry, hydraulic or other actuation circuitry, and other appropriate circuitry.

Bit information input 212 may include a user input of bit type and a desired weight, or force, on the bit per diameter. Bit type may include different types (e.g., size, weight, etc.) of down-the-hole drill bits. The desired weight, or force, on the bit per diameter may be a default or nominal value for a given bit type for maintaining an effective hammering operation. For example, different types of bits may include different desired weight, or force, on the bit per diameter for maintaining the effective hammering operation. The desired weight, or force, on the bit per diameter may be determined by a user input of the diameter of the bit based on bit type. The user input may be received from an input device 40 (FIG. 1), such as a touch-screen display device, number pad, or the like.

Drill string weight input 214 may include a total weight of the drill string 28. The total weight of the drill string may be determined by a weight of the rotary head assembly 26, a weight of the drill pipes currently on the drill string 28, and a weight of the drill bit assembly. The weight of the rotary head assembly may be input by a user or may be pre-loaded and stored in the memory of controller 210. The weight of the drill pipes currently on the drill string may be determined based on a user input of the number of pipes currently on the drill string, or based on the system automatically tracking the number of pipes currently on the drill string. To determine the weight of the drill pipes currently on the drill string, controller 210 may calculate the input or tracked number of pipes multiplied with the weight of a single pipe. The weight of the drill bit assembly may be determined by a user input or may be pre-loaded in the memory of controller 210.

Bit air pressure input 216 may be a sensor for detecting and/or communicating a net force acting on the air supply line. Forces acting on the air supply line may include air pressure. Bit air pressure input 218 may be received from an air pressure sensor configured to communicate an air pressure signal indicative of air pressure of the air supply line on the drill bit 30 to controller 210. For example, an air pressure sensor may be located in the air supply line adjacent the air supply 32 so as to detect pressure of fluid (e.g., air) within the air supply line. It is understood that the air pressure sensor may be located anywhere along the air supply line. Bit air pressure input 216 may also derive air pressure information from other sources, including other sensors.

Pulldown force input 218 may include a sensor or other mechanism configured to detect and/or communicate a force acting on the drill string 28, and thus on the drill bit 30. In the system described in FIG. 1, the force may be the pulldown force acting on the drill bit 30—the force exerted by the hydraulic feed cylinder 34 through the rotary head 26 to the drill string 28, and thus to the drill bit 30. As such, the pulldown force may be derived from a pressure of the hydraulic feed cylinder. Thus, pulldown force input 218 may include a sensor for detecting a net force acting on the hydraulic feed cylinder 34, which may be controlled by controller 210, as detailed below. Forces acting on the hydraulic feed cylinder 34 may include a head end pressure and a rod end pressure. For example, pulldown force input 218 may be one or more pressure sensors configured to communicate a pressure signal to controller 210. The pressure sensors may be disposed within the hydraulic fluid line, at a pump of the hydraulic fluid tank 36, and/or within a head of hydraulic feed cylinder 34. Further, pulldown force input 218 may include a force on bit that includes a weight of the rotary head 26 and a weight of the drill string 28 on the drill bit 30. As such, the pressure signals may be added to the weight of the rotary head 26 and the drill string 28 acting on the drill bit 30 to derive pulldown force input 218. Alternatively, any sensor associated with pulldown force input 218 may be disposed in other locations relative to the hydraulic feed cylinder 34. Pulldown force input 218 may also derive pulldown force information from other sources, including other sensors.

The air pressure limits input, air pressure stable conditions, force on bit input, bit tables, and force factor input may be stored in the memory of controller 210. Air pressure limits may include maximum, or high, limits for an amount of air pressure provided for the piston of the hammer-type drill bit 30. For example, the air pressure limits may include a target air pressure value for operating the hammer-type drill bit 30. The target air pressure value may be a target value for an effective hammering operation of drill bit 30. The target air pressure value may also include a range of air pressure values. Further, the air pressure limits for bit air pressure 216 (e.g., the target air pressure value) may be configurable—adjustable based on user inputs, or may be manufacturer set values and not configurable.

The air pressure stable condition may include stored values for a stable condition and unstable condition of the bit air pressure input 216. The stable condition may include a first predetermined air pressure threshold being held for a predetermined amount of time. For example, the stable condition may be 1,000 kilopascals (KPa) per second for 2 seconds. If the bit air pressure input 216 changes by 1,000 Kpa (or less) per second for 2 seconds, the bit air pressure may be determined to be stable. Thus, the stable condition may correspond to the bit air pressure input 216 being stable (e.g., little or no change). The unstable condition may include a second predetermined air pressure threshold greater than the first threshold. For example, the unstable condition may be 1,500 KPa per second. If the bit air pressure input 216 changes by at least 1,500 KPa per second (for any amount of time), the bit air pressure may be determined to be unstable. Thus, the unstable condition may correspond to the bit air pressure input 216 being unstable. Further, the air pressure stable condition for bit air pressure 216 (e.g., the stable conditions and the unstable conditions) may be manufacturer set values.

The force on bit input may be a stored value for a current amount of force (e.g., pulldown force 218) applied to the drill string 28, and thus to the drill bit 30. The bit tables may include a desired force on bit for a given bit type and diameter of bit. For example, different bit types and sizes may each include a different desired force on bit for an effective hammering operation of drill bit 30. Thus, as an initial setting, the force on bit input may be set to the desired force on bit from the bit table. The force factor input may include a stored dimensionless factor value for multiplying to the force on bit in order to adjust the force on the drill bit 30, as detailed below.

For outputs of control system 200, controller 210 may control and/or adjust the pulldown force 218 (e.g., the net force acting on the hydraulic feed cylinder 34), as described below with reference to FIGS. 3 and 4.

INDUSTRIAL APPLICABILITY

The disclosed aspects of automatic force adjustment control system 100 of the present disclosure may be used in any drilling machine having a drill bit 30.

As used herein, the terms automated and automatic are used to describe functions that are done without operator intervention. The methods 300, 400 of FIGS. 3 and 4 may be automated or automatic and thus proceed without operator intervention. Further, the methods 300, 400 could be used with other automated control systems of drilling machine 10, such as an automatic jam avoidance function, an automatic anti-jam function, or any other automatic functions.

With reference to FIG. 1, drilling machine 10 may include an automatic down-the-hole drilling operation. The automatic down-the-hole drilling operation may include an automatic collaring phase to form the collaring portion 52 of hole 50 and/or an automatic drilling phase to drill, and form, hole 50. Down-the-hole drilling may further include applying a pulldown force from hydraulic feed cylinder 34 to rotary head 26 for controlling the feed rate of the drill bit 30 (attached to the drill string 28 mounted on the rotary head 26) into the ground. As such, the hammer-type drill bit 30 may exert an axial force on the bottom surface 54 of the hole 50 as the drill bit 30 moves down for creating the hole 50. An opposite axial force, or compression load force, is exerted on the drill bit 30 (and thus the drill string 28) by the bottom surface 54 of the hole 50. During the automatic down-the-hole drilling operation, it is desirable to maintain the compression load force on the drill bit 30 at the stored desired force on bit (e.g., determined from the corresponding bit table for the given bit type) while the drill bit 30 moves down the hole. However, under certain conditions, the measured bit air pressure 216 may increase and/or decrease beyond the target air pressure value during the automatic down-the-hole drilling operation while maintaining the load force at the stored desired force on bit. For example, the bit air pressure 216 may increase above the target air pressure value if the desired force on bit (e.g., pulldown force 218) is too great for the given ground material (e.g., hard rock). Likewise, the bit air pressure 216 may decrease below the target air pressure value if the desired force on bit (e.g., pulldown force 218) is too little for the given ground material (e.g., softer rock or dirt). Thus, the hammering motion of the drill bit may be inhibited, ineffective, and/or the drill bit 30 may be damaged or may wear at a faster rate than expected or desired.

Figure 3:
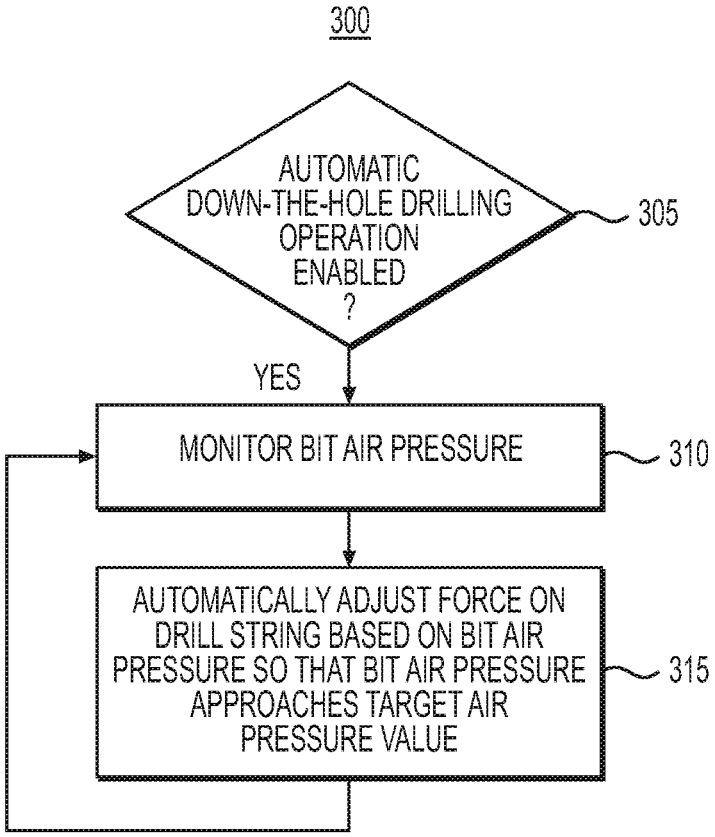
FIG. 3 provides a flowchart depicting an exemplary method for automatically adjusting a force on a down-the-hole drill bit for the system of FIG. 1, according to one aspect of the present disclosure.

FIG. 3 provides an exemplary method 300 for automatically adjusting a force on the down-the-hole drill bit 30, according to one aspect. In step 305, controller 210 may determine whether the automatic down-the-hole drilling operation is enabled. During the automatic down-the-hole drilling operation (step 305: YES), controller 210 may monitor bit air pressure input 216 (step 310). In step 315, controller 210 may automatically adjust the force on the drill string 28 (and thus the drill bit 30) based on the monitored bit air pressure so that the bit air pressure approaches a target air pressure value. As used here, "approaches" may include movement of the monitored bit air pressure towards, and/or close within a range of, the target air pressure value, but does not require obtaining the actual target. For example, controller 210 may both raise and lower the force provided to the drill string 28. In one embodiment, controller 210 may inhibit the automatically adjusting of the force to the drill string until the monitored bit air pressure has stabilized. During the automatic down-the-hole drilling operation, controller 210 may continuously monitor bit air pressure input 216 (step 310) and adjust the force on drill string 28 (step 315) based on the monitored bit air pressure accordingly.

Figure 4:
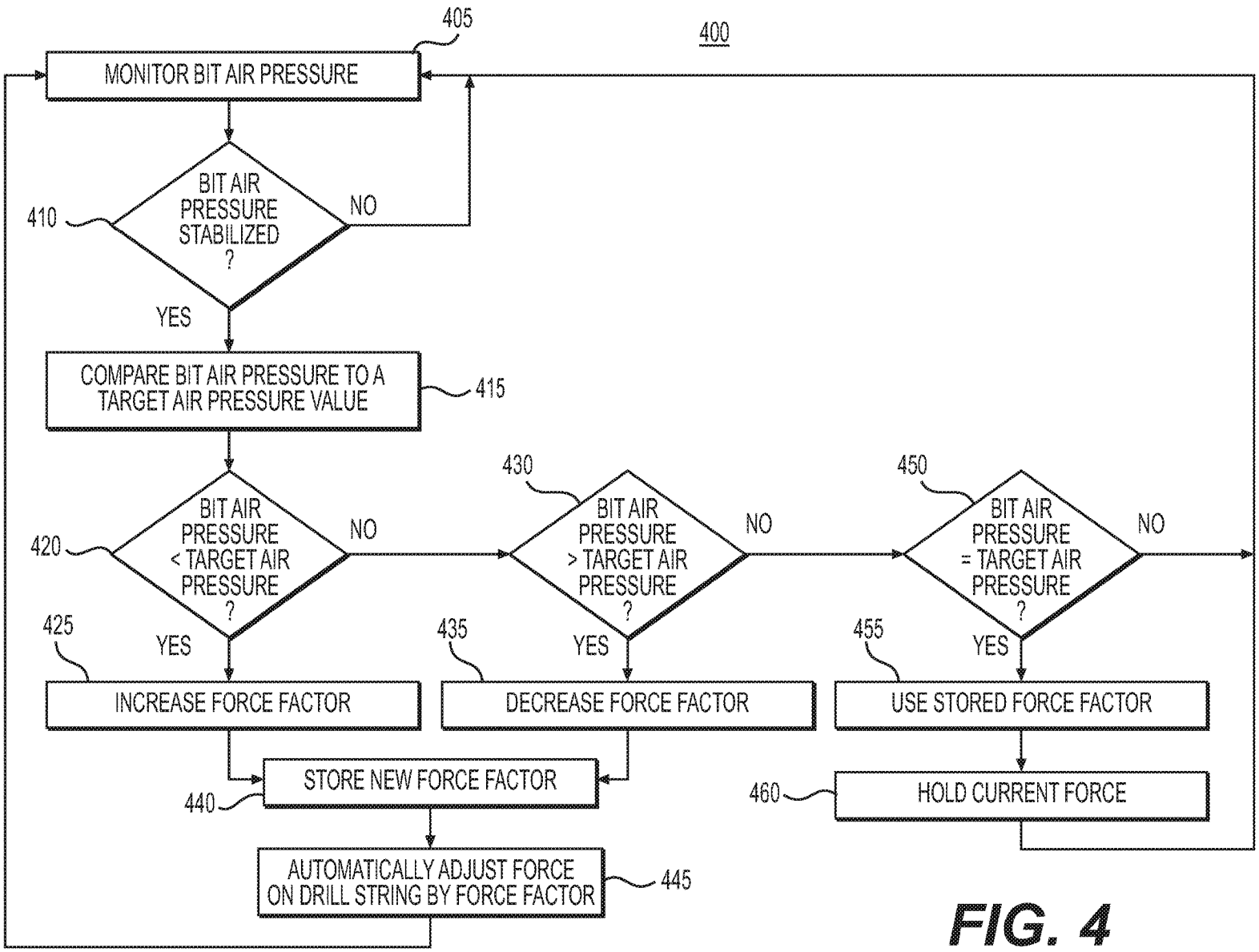
FIG. 4 provides a flowchart depicting a method including a detailed implementation of performing the method of FIG. 3.

FIG. 4 provides an exemplary method 400 for automatically adjusting a force on the down-the-hole drill bit 30. It is noted that method 400 may include one example of implementing method 300 of FIG. 3. However, method 300 may be implemented in other ways. In step 405, controller 210 may monitor the bit air pressure input 216 (e.g., step 310 of FIG. 3). In step 410, controller 210 may determine if the bit air pressure has stabilized. As noted above, controller 210 may determine that the bit air pressure 216 has stabilized when the rate of change of bit air pressure 216 is at or below the air pressure stable condition. If the bit air pressure has not stabilized (step 410: NO), controller 210 may continue to monitor bit air pressure (step 405). When the bit air pressure has stabilized (step 410: YES), controller 210 may compare the monitored bit air pressure to a target air pressure value (step 415). As noted above, the target air pressure value may be a target value for providing an effective hammering operation of the drill bit 30. The target air pressure value may be manufacturer set value and/or may be configurable by user input. Further, the target air pressure value may include a range of air pressure values. For example, the bit air pressure 216 may be determined to be at the target air pressure value if the bit air pressure 216 is within the range of air pressure values. The target air pressure value may also include a target high air pressure value. The target high air pressure value may correspond to a high air pressure value that is desired to not be exceeded in order to provide the effective hammering operation. For example, if the bit air pressure 216 increase above the target high air pressure value, the hammering operation may be backed off (e.g., via the jam avoidance function and/or anti jam function). If the bit air pressure 216 decreases below the target high air pressure value, the hammering operation may be ineffective as the bit air pressure 216 may not be generating enough force to hammer into the ground material.

In step 420, controller 210 may determine if the monitored bit air pressure is less than the target air pressure value. If the monitored bit air pressure is less than the target air pressure value (step 420: YES), controller 210 may increase the force factor (step 425). As noted above, the force factor may include a stored dimensionless factor value for multiplying to the force on bit in order to adjust the force on the drill bit 30. The force factor may correspond to a magnitude of difference between the monitored bit air pressure and the target air pressure value. As detailed above, the set desired force on bit (determined by bit type and size) may not be adequate for different ground materials. Further, the desired force on bit may not be easily and/or readily configurable by user input. Thus, the force factor may be used to adjust the desired force on bit to adjust the force on bit 30 and to provide adequate force on the drill bit 30 for an effective hammering operation, as further detailed below.

If the monitored bit air pressure is not less than the target air pressure value (step 420: NO), controller 210 may determine whether the monitored bit air pressure is greater than the target air pressure (step 430). If the monitored bit air pressure is greater than the target air pressure value (step 430: YES), controller 210 may decrease the force factor (step 435). In step 440, controller 210 may store the new force factor (e.g., the increased or decreased factor). To automatically adjust the force on the drill string 28 so that the bit air pressure approaches the target air pressure value (step 315), in step 445, controller 210 may automatically adjust the force on the drill string 28 (and thus the drill bit 30) by the force factor. Controller 210 may multiply the force on the drill string 28 by the force factor to automatically adjust the force on the drill string 28.

If the monitored bit air pressure is not greater than the target air pressure value (step 430: NO), controller 210 may determine whether the monitored bit air pressure is equal to the target air pressure value (step 450). If the monitored air pressure is equal to the target air pressure value (and/or the monitored bit air pressure is within the range of target air pressure values) (step 450: YES), controller 210 may use the stored force factor (step 455) and hold the current force on the drill string 28 (step 460). For example, the force on the drill string 28 may not need to be adjusted when the monitored bit air pressure is equal to the target air pressure value. During the automatic down-the-hole drilling operation, controller 210 may continuously monitor the bit air pressure input 216 (step 405) and automatically adjust the force on the drill string 28 by the force factor (step 445), as needed, so that the bit air pressure approaches the target air pressure.

Such an automatic force adjustment control system 100 may improve performance of drilling machine 10 and may enable a faster automatic down-the-hole drilling operation. For example, as noted above, drilling through different types of materials may vary the force on the drill bit, and thus the drill bit may wear differently. Accordingly, system 100 may help to ensure the compression load force on the drill bit 30 is adequately adjusted during the drilling operation to maintain an effective hammering operation of the drill bit 30. Such a system 100 may create a more intuitive operator control and may allow more autonomy of the drilling machine 10. Thus, the automatic force adjustment control system 100 of the present disclosure may help to improve drill bit life by reducing damage to the drill bit during the drilling operation, while decreasing overall drilling time.

It will be apparent to those skilled in the art that various modifications and variations can be made to the disclosed system without departing from the scope of the disclosure. Other embodiments of the disclosure will be apparent to those skilled in the art from consideration of the specification and practice of the invention disclosed herein. For example, different indications of force on the drill bit may be used and/or different ways of adjusting the force on the drill bit may be implemented. It is intended that the specification and examples be considered as exemplary only, with a true scope and spirit of the invention being indicated by the following claims.

What is claimed is:

1. A method for automatically adjusting a force on a down-the-hole drill bit of a drill string of a mobile drilling machine, comprising:

monitoring bit air pressure of the down-the-hole drill bit during an automatic down-the-hole drilling operation, the bit air pressure being supplied to the down-the-hole drill bit to provide a hammering action at the bit;

comparing the monitored bit air pressure to a target air pressure value, the target air pressure value being configured to maintain an effective operation of the down-the-hole drill bit;

based on the comparing, determining whether the monitored bit air pressure is below the target air pressure value or above the target air pressure value; and automatically adjusting a pulldown force provided to the drill string based on the monitored bit air pressure, wherein the automatically adjusting the pulldown force is performed by at least one controller configured to:

upon determining that the monitored bit air pressure is below the target air pressure value, automatically increase the pulldown force provided to the drill string; and upon determining that the monitored bit air pressure is above the target air pressure value, automatically decrease the pulldown force provided to the drill string.

2. The method of claim 1, wherein the target air pressure value is a high air pressure value.

3. The method of claim 1, further including inhibiting the automatically adjusting of the pulldown force to the drill string until the monitored bit air pressure has stabilized.

4. The method of claim 1, wherein the target air pressure value is a configurable value.

5. The method of claim 1, further comprising adjusting the pulldown force by a force factor corresponding to a magnitude of difference between the monitored bit air pressure and the target air pressure value.

6. The method of claim 5, further comprising increasing the force factor when the monitored bit air pressure is below the target air pressure value.

7. The method of claim 5, further comprising decreasing the force factor when the monitored bit air pressure is above the target air pressure value.

8. The method of claim 5, further comprising holding the force factor at a stored force factor when the monitored bit air pressure is equal to the target air pressure value.

9. The method of claim 1, wherein:

monitoring bit air pressure includes monitoring an air pressure signal indicative of air pressure of an air supply line on the down-the-hole drill bit; and automatically adjusting the pulldown force provided to the drill string includes using a hydraulic cylinder.

10. The method of claim 1, wherein:

determining that the monitored bit air pressure is below or above the target air pressure value occurs while maintaining a stored desired force on the down-the-hole drill bit.

11. A method for automatically adjusting a force on a down-the-hole drill bit of a drill string of a mobile drilling machine, comprising:

monitoring bit air pressure of the down-the-hole drill bit during an automatic down-the-hole drilling operation, the bit air pressure being supplied to the down-the-hole drill bit to provide a hammering action at the bit;

when the monitored bit air pressure is stabilized, comparing the monitored bit air pressure to a target air pressure value, wherein the target air pressure value is a target value for maintaining an effective hammering operation of the drill bit on a bottom surface of a hole during the automatic down-the-hole drilling operation;

based on the comparing, determining whether the monitored bit air pressure is below the target air pressure value or above the target air pressure value; and automatically, via a controller, adjusting a pulldown force provided to the drill string based on the monitored bit air pressure, wherein the controller is configured to:

upon determining that the monitored bit air pressure is below the target air pressure value, automatically increase the pulldown force provided to the drill string; and upon determining that the monitored bit air pressure is above the target air pressure value, automatically decrease the pulldown force provided to the drill string.

12. The method of claim 11, further comprising adjusting the pulldown force by a force factor corresponding to a magnitude of difference between the monitored bit air pressure and the target air pressure value.

13. The method of claim 12, further comprising increasing the force factor when the monitored bit air pressure is below the target air pressure value.

14. The method of claim 12, further comprising decreasing the force factor when the monitored bit air pressure is above the target air pressure value.

15. A mobile drilling machine, comprising:

a mast including a mast frame;

a drill head movably mounted on the mast frame, the drill head controllable to rotate a down-the-hole drill bit mounted on a drill string;

an air supply configured to supply air at a bit air pressure to the down-the-hole drill bit to provide a hammering action at the drill bit;

a drill drive assembly configured to apply a force to move the drill head up and down along a length of the mast frame; and a controller configured to:

monitor bit air pressure of the down-the-hole-drill bit during an automatic down-the-hole drilling operation;

compare the monitored bit air pressure to a target air pressure value;

based on the comparing, determine whether the monitored bit air pressure is below the target air pressure value or above the target air pressure value; and automatically adjust the force applied by the drill drive assembly, based on the monitored bit air pressure, wherein the automatically adjusting the force includes:

upon determining that the monitored bit air pressure is below the target air pressure value, automatically increase the force; and upon determining that the monitored bit air pressure is above the target air pressure value, automatically decrease the force.

16. The mobile drilling machine of claim 15, wherein the controller is further configured to:

inhibit the automatically adjusting of the force until the monitored bit air pressure has stabilized.

17. The mobile drilling machine of claim 15, wherein the controller is further configured to:

adjust the force by a force factor corresponding to a magnitude of difference between the monitored bit air pressure and the target air pressure value.

18. The mobile drilling machine of claim 17, wherein the controller is further configured to:

increase the force factor when the monitored bit air pressure is below the target air pressure value.

19. The mobile drilling machine of claim 17, wherein the controller is further configured to:

decrease the force factor when the monitored bit air pressure is above the target air pressure value.

20. The mobile drilling machine of claim 17, wherein the controller is further configured to:

hold the force factor at a stored force factor when the monitored bit air pressure is equal to the target air pressure value.

* * * * *